United States Patent [19]

Thomas et al.

[11] 4,289,350

[45] Sep. 15, 1981

[54] COMBINED FOLDING TABLE AND SEAT

[76] Inventors: Robert J. Thomas, 3451 Academy, Dearborn, Mich. 48124; Richard J. Smith, 27005 Michigan Ave., Inkster, Mich. 48141

[21] Appl. No.: 90,304

[22] Filed: Nov. 1, 1979

[51] Int. Cl.[3] ..... A47B 39/06; A47B 3/02

[52] U.S. Cl. ..... 297/172; 108/113; 108/118; 297/159

[58] Field of Search ..... 297/159, 172, 156, 174, 297/44; 108/113, 99, 100, 118

[56] References Cited

U.S. PATENT DOCUMENTS

| | | | |
|---|---|---|---|
| 1,823,484 | 9/1931 | Blumenthal | 297/159 |
| 1,856,977 | 5/1932 | Swensson | 297/172 X |
| 2,817,170 | 12/1957 | Skelton et al. | 297/174 |
| 3,674,306 | 7/1972 | Botney | 297/183 X |
| 3,833,256 | 9/1974 | Dehner | 297/44 |

FOREIGN PATENT DOCUMENTS

| | | | |
|---|---|---|---|
| 582943 | 4/1957 | Italy | 297/159 |
| 607273 | 8/1960 | Italy | 297/159 |
| 61170 | 3/1912 | Switzerland | 297/172 |

*Primary Examiner*—James T. McCall

[57] ABSTRACT

A folding table and seat combination, including a pair of tubular elements, which are bent to form support sections, legs and base rails or runners, the combination being arranged to form a pair of matched units, which are foldable along a substantially longitudinal median line.

4 Claims, 4 Drawing Figures

COMBINED FOLDING TABLE AND SEAT

This invention relates to furniture and has particular reference to a folding table and seat combination, which is light in weight, highly portable, and can be stored in a limited space. It can readily be used in or out of doors, for almost any purpose. It is particularly useful at the beach, or when camping, or doing engineering field work, or the like. It can be stored in the trunk of a car and can be carried in one hand by a user.

An object of the invention is to generally improve the art and to provide a folding table and seat combination which is compact, simple in construction, economical to manufacture, and efficient in operation.

Another object of the invention is to provide a combined table and seat which is economically fabricated with relatively few parts.

Another object of the invention is to provide a combination as disclosed, which is formed of a pair of tubular elements, which are bent to form the principle support members of the device.

Another object of the invention is to provide a folding table and seat with adjustable support members.

Another object of the invention is to provide a folding seat member which is re-inforced with an over-lying member arranged to prevent pinching of the occupant of the seat when in use.

PRIOR ART

The prior art is best illustrated in the disclosures of U.S. Pat. Nos. 1,856,977 and 2,421,127.

In the U.S. Pat. No. 1,856,977 to Swensson, the folding combination consists of a desk and a chair which are pivoted to side rails 1 and 2, and collapse into a substantially wide rectangular form, as shown in FIG. 2 of the Patents.

In U.S. Pat. No. 2,421,127 to Peckham, the combination consists of a table and seat, which fold downwardly and collapse into a final form similar to that of Swensson.

On the other hand, the applicant folds and collapses his table and seat upwardly, along a substantially longitudinal median line as has been described.

DRAWINGS

The foregoing objects and advantages of the invention will appear as the description proceeds, reference being made from time to time, to the accompanying drawings forming part of the disclosure, in which drawings.

DETAILED DRAWINGS

Figure 1:
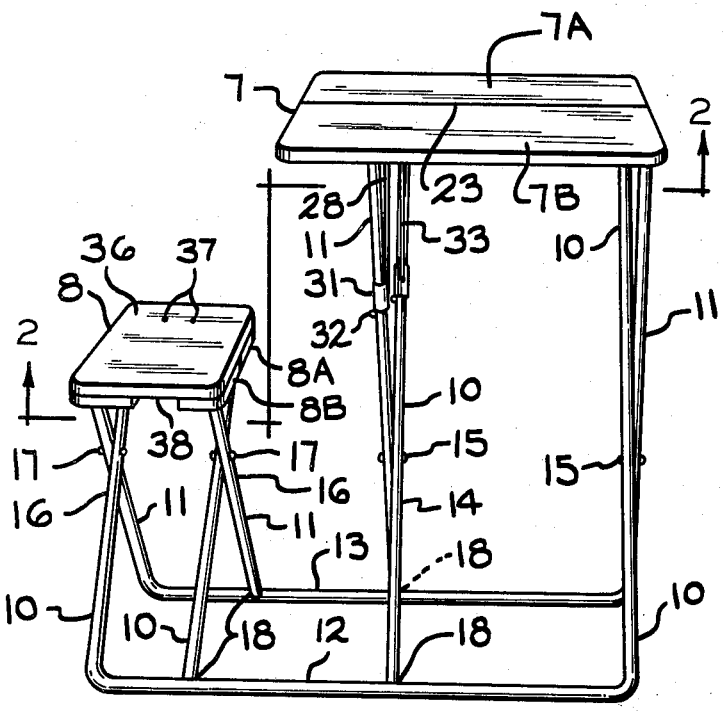
FIG. 1, is a side elevational view of the invention device unfolded and ready for use.

Referring now more particularly to the drawings, it will be understood that in the embodiment herein disclosed, the reference character 7 indicates the table, and the reference character 8 indicates the seat of the device.

Figure 2:
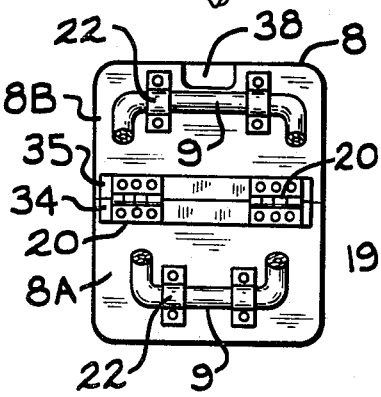
FIG. 2, is a bottom plan view, with parts broken away, and taken substantially on the line 2—2 of FIG. 1.
Figure 2:
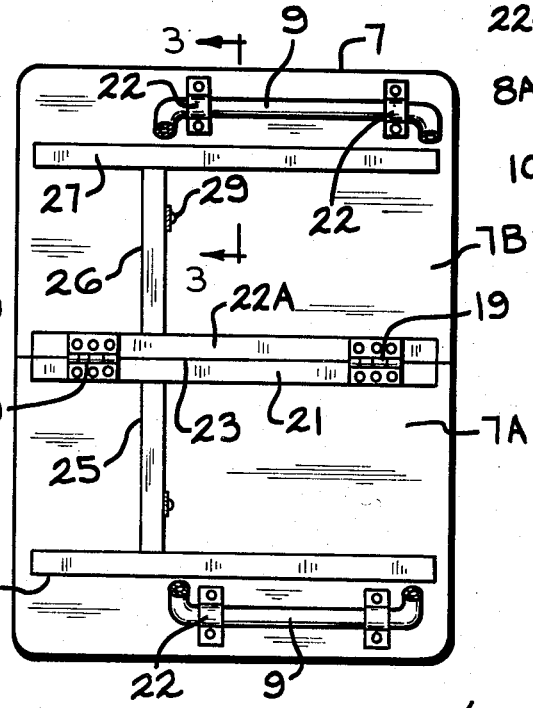

The under carriage assembly for supporting the table 7 and seat 8 preferably comprises a pair of elongated tubular elements 10 and 11, which are bent to form a plurality of support section 9 (FIG. 2) and a pair of base rails or runners 12 and 13, and pairs of table legs 14, which are pivoted as 15, and pairs of seat legs 16, which are pivoted as 17. The support sections 9, (FIG. 2) are secured to the undersides of the table 7 and seat 8 by metal straps 22 and screws, or other suitable means. The terminal ends of each tubular element 10 and 11 are welded to the rails 12 and 13 as at 18, (FIG. 1).

As shown in (FIG. 2) the table 7 is divided into sections 7A and 7B, and the seat 8 is divided into sections 8A and 8B along a horizontal median line common to both. The sections 7A and 7B are hinged together as at 19, and the seat sections 8A and 8B are hinged together as at 20. The hinges 19 are secured to two wood strips 21 and 22A, which are in turn, secured by any suitable means to the under faces of sections 7A and 7B. The strips 21 and 22A abut along the median line 23 and their abutting faces are of sufficient depth to provide great strength to the folded table 7. Additional wood strips 24, 25, 26 and 27 are secured by any suitable means, to the under face of the table 7 to provide added strength, when table 7 is set up as shown in FIG. 1.

Figure 3:
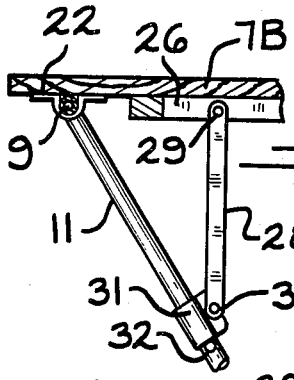
FIG. 3, is an enlarged detail, partly in section, taken substantially on the line 3—3 of FIG. 2.
Figure 4:
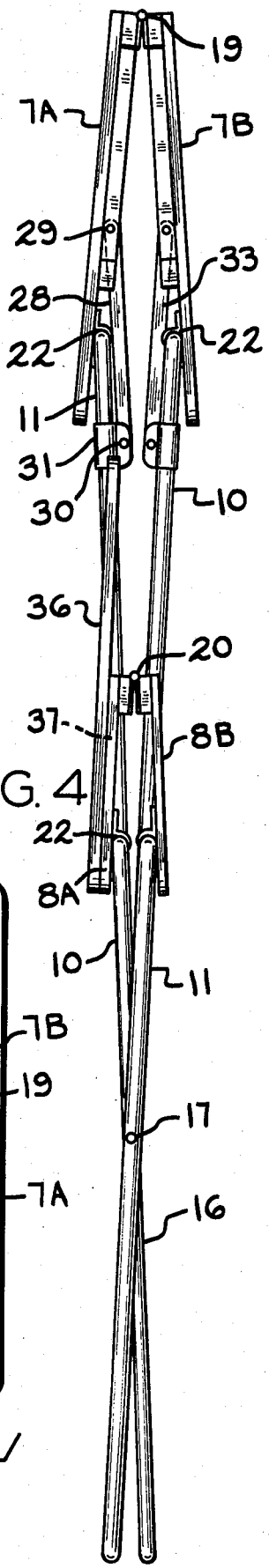
FIG. 4, is an enlarged, left and elevational view of the device shown in FIG. 1, in fully folded condition, ready for storage or transportation.

The table section 7B is further re-inforced, as shown in FIG. 3, by a strut 28, which is pivoted as at 29, to the wood strip 26 and is pivoted as 30 a slidable collar 31, which surrounds one of the table legs 10. The downward movement of the collar 31 is limited by a stop element 32. A similar strut 33 re-inforces the table section 7A (FIGS. 1 and 4).

The seat sections 8A and 8B are hinged as at 20 (FIG. 2) and are provided with abutting wood strips 34 and 35, which are secured and function, as previously described in the description of the table 7.

It will be noted that in addition to the seat sections 8A and 8B, the seat 8 is provided with a rigid cover member 36 (FIGS. 1 and 4) which is riveted as at 37 to the seat section 8A to provide a re-inforced and smooth seating surface when the seat 8 is occupied.

The seat section 8B is provided with a hand cut-out portion 38, so that the free end of the seat cover member 36 may be elevated in the folding operation of the device herein described.

The preferred method of folding the combined table 7 and seat 8 is for the operator to face the device as set up in FIG. 1, and with a foot on the near runner 12, and using the left hand to lift the seat cover 36, by inserting the hand in the cut-out 38 in the seat section 8B, and with the right hand under the table 8, near the median line 23, lifting it upward to collapse the device into a narrow, elongated configuration, as shown in FIG. 4. The folded device may then be tilted into a horizontal position and may be carried by one hand.

Having described my invention, what I claim and desire to protect by Letters Patent is:

1. A folding table and seat combination comprising two elongated tubular members each bent to form in the same plane a base rail, two pairs of parallel legs unequal in length, and a support section between each pair of parallel legs, each such pair of parallel legs having one leg the lower end of which is permanently attached to the base rail, pivotal means connecting together the parallel legs on the two elongated tubular members so that the support sections thereon are disposed opposite each other, a table having two hinged sections pivotally attached to the two oppositely disposed support sections between the two longer pairs of parallel legs, and a seat having two hinged sections pivotally attached to the two oppositely disposed support sections between the two shorter pairs of parallel legs.

2. The structure of claim 1, having in addition thereto, a slidable collar on at least one of the legs associated with the table, a strut pivotally connected between the slidable collar and one of the hinged members of the table, and a stop element on the legs with the slidable collars thereon providing a travel limit for such slidable collars.

3. The structure of claim 2, having in addition thereto, a flat panel on the seat co-extensive therewith and attached to one of the hinged members of the seat.

4. The structure of claim 3, in which one of the hinged members of the seat has a hand cut-out section to facilitate lifting of the flat panel in the course of folding the structure.

* * * * *